US007559853B2

(12) United States Patent
Hirano

(10) Patent No.: US 7,559,853 B2
(45) Date of Patent: Jul. 14, 2009

(54) GOLF CLUB HEAD AND METHOD FOR MANUFACTURING THE SAME

(75) Inventor: Tomoya Hirano, Kobe (JP)

(73) Assignee: SRI Sports Limited, Hyogo-Ken (JP)

( * ) Notice: Subject to any disclaimer, the term of this patent is extended or adjusted under 35 U.S.C. 154(b) by 375 days.

(21) Appl. No.: 11/414,223

(22) Filed: May 1, 2006

(65) Prior Publication Data

US 2006/0287131 A1 Dec. 21, 2006

(30) Foreign Application Priority Data

Jun. 20, 2005 (JP) ..... 2005-179704

(51) Int. Cl.
*A63B 53/04* (2006.01)

(52) U.S. Cl. ..... 473/324; 473/342; 473/345; 473/349

(58) Field of Classification Search ..... 473/324–350, 473/287–292; 164/76.1; 228/234.1
See application file for complete search history.

(56) References Cited

U.S. PATENT DOCUMENTS 6,248,025 B1 * 6/2001 Murphy et al. ..... 473/324
6,494,790 B1 * 12/2002 Toyota et al. ..... 473/345
6,524,194 B2 * 2/2003 McCabe ..... 473/305
6,533,681 B2 * 3/2003 Inoue et al. ..... 473/342
6,929,566 B2 * 8/2005 Sano ..... 473/349
7,025,693 B2 * 4/2006 Sugimoto ..... 473/342
7,182,699 B2 * 2/2007 Matsunaga ..... 473/345
2003/0084970 A1 * 5/2003 Ariyasu et al. ..... 148/421

FOREIGN PATENT DOCUMENTS

JP 8-280853 A 10/1996

* cited by examiner

*Primary Examiner*—Sebastiano Passaniti
(74) *Attorney, Agent, or Firm*—Birch, Stewart, Kolasch & Birch, LLP

(57) ABSTRACT

A golf club head and a manufacturing method therefor in which the coefficient of restitution can be easily adjusted to desirable values for example the upper limit specified by Golf the Rules without impairing the durability and the directional stability. The head comprises a face member having a ball striking club face, and a main member at the front of which the face member is disposed, wherein the face member is produced from a titanium alloy, and the main member is produced from another titanium alloy having a larger specific gravity than that of the face member's titanium alloy.

10 Claims, 9 Drawing Sheets

GOLF CLUB HEAD AND METHOD FOR MANUFACTURING THE SAME

BACKGROUND OF THE INVENTION

The present invention relates to a golf club head, and more particularly to a method for manufacturing a golf club head capable of adjusting the coefficient of restitution of the titanium face easily without degrading other performances.

In recent years, with the progress of manufacturing technology and the like, various golf club heads having large coefficient of restitution and large moment of inertia have been proposed, for instance, as disclosed in JP-A-8-280853. Thus, the increase in ball carry distance in recent years is very notable. Therefore, concerned about such a tendency to increase carry distances leaning on the manufacturing technologies, golf associations, e.g. "U.S.G.A.", "R & A" and the like have established a rule that controls the coefficient of restitution*1 of golf club heads to a certain value (less than 0.830). Actually, most of wood-type hollow titanium face club heads put on the market at present have a coefficient of restitution of 0.830 or more. Therefore, in order to make golf clubs usable in official competitions, it is needed to use a club head having a coefficient of restitution smaller than those of conventional club heads so as to meet the above-mentioned regulated value for the coefficient of restitution.

(*1: measured according to the U.S.G.A Procedure for Measuring the velocity Ratio of a Club Head for conformance to Rule 4-1e, Revision 2, Feb. 8, 1999)

An effective method for decreasing the coefficient of restitution is to increase the rigidity of the face portion of club heads by increasing the thickness thereof. If however the face portion is increased in the thickness, as the weight of the face portion increases, the center of gravity of the head shifts toward the club face and the depth thereof becomes shallow. In the case of a hollow titanium alloy head for driver having a volume of 400 cc and a face surface area of 40 sq.cm, if the thickness of the face portion is increased by 0.5 mm, the weight of the head increases by 5 grams in the face portion. Accordingly, a significant amount of shift of the center of gravity toward the face is unavoidable. As well known, a club head having a shallow depth of the center of gravity has a poor directional stability with respect to shot directions since the amount of movement of the head at miss shot becomes large, but rather the increase in the weight impose restraints on the design freedom for the head especially the center of gravity.

SUMMARY OF THE INVENTION

It is therefore, an object of the present invention to provide a golf club head and a manufacturing method therefor in which the coefficient of restitution can be easily adjusted while preventing the shifting of the center of gravity, without imposing restraints on the design freedom.

According to one aspect of the present invention, a golf club head comprises a face member forming a club face for striking a ball, and a main member at the front of which the face member is disposed, wherein the face member is made of a first titanium alloy, and the main member is made of a second titanium alloy having a larger specific gravity than that of the first titanium alloy.

Therefore, even if the thickness in the club face is increased in order to lower its coefficient of restitution, shifting of the center of gravity toward the front of the head can be minimized. Thus, it is possible to realize the club face having a low coefficient of restitution while preventing the depth of the center of gravity from becoming shallow.

This and other objects of the present invention will become apparent from the description hereinafter.

DESCRIPTION OF THE PREFERRED EMBODIMENTS

Figure 1:
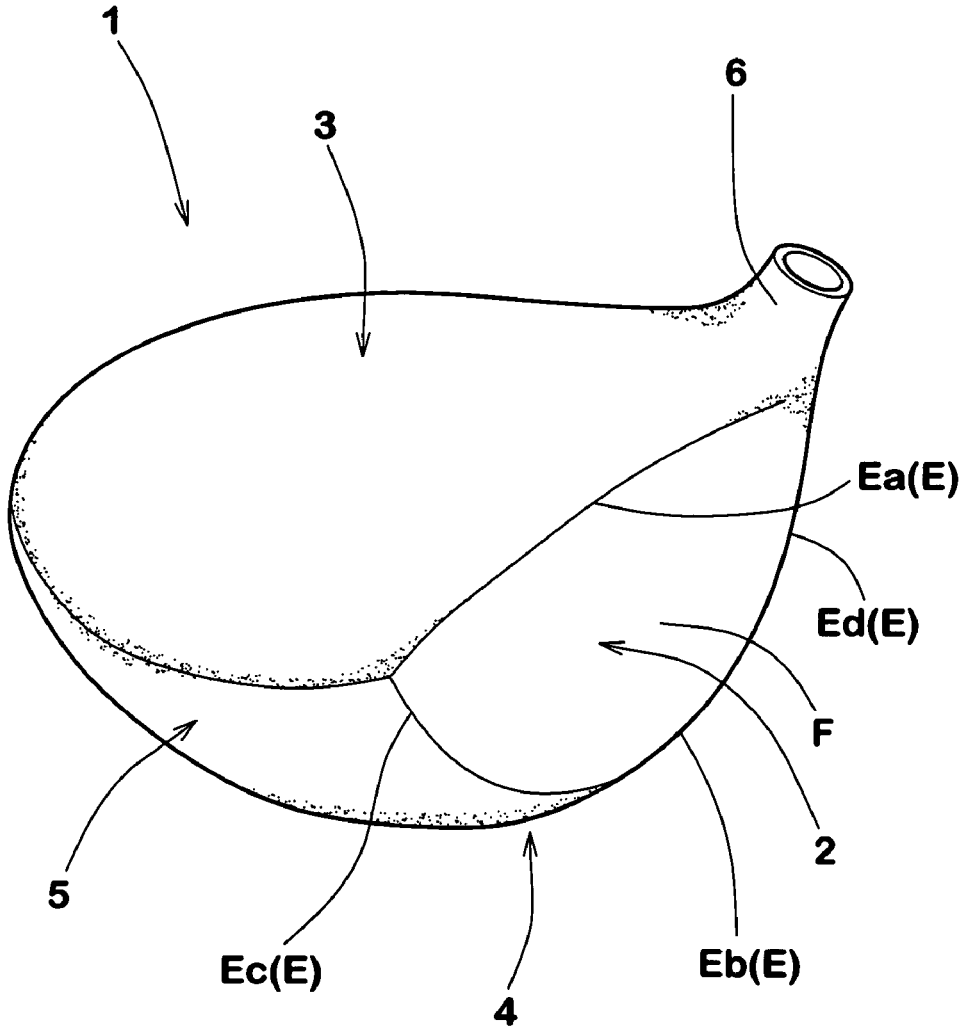
FIG. 1 is a perspective view of a wood-type golf club head according to the present invention.

Embodiments of the present invention will now be described in conjunction with the accompanying drawings.

In the drawings, golf club head 1 according to the present invention is a wood-type hollow head.

Figure 2:
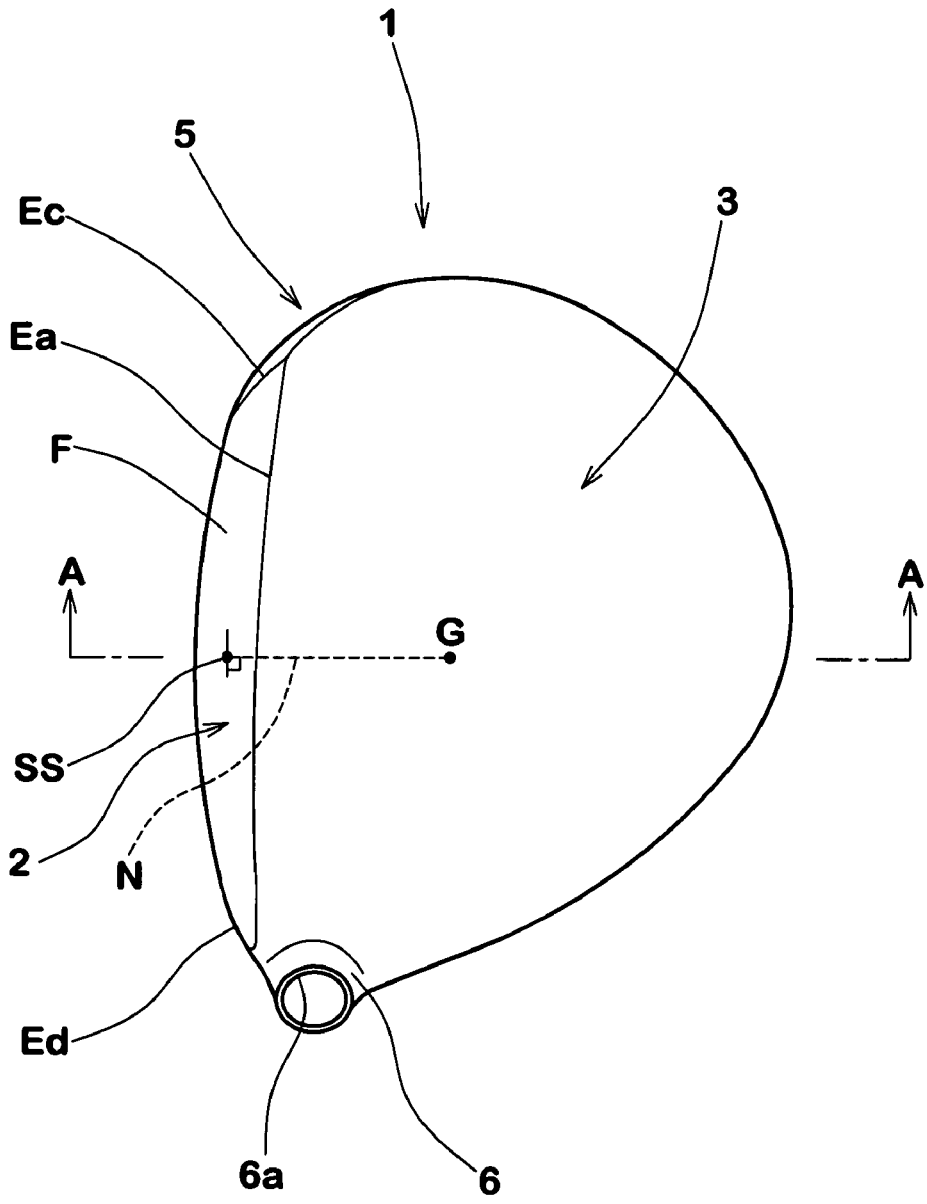
FIG. 2 is a top view thereof.

As shown in FIGS. 1 and 2, the wood-type golf club head 1 comprises: a face portion 2 of which front face defines a club face F for striking a ball and rear face faces a hollow (i); a crown portion 3 defining an upper surface of the head intersecting the club face F at the upper edge Ea thereof; a sole portion 4 defining a bottom surface of the head intersecting the club face F at the lower edge Eb thereof; a side portion 5 between the crown portion 3 and sole portion 4 which extends from a toe-side edge EC to a heel-side edge Ed of the club face F through the back face of the club head; and a hosel portion 6 to be attached to an end of a club shaft (not shown). The hosel portion 6 protrudes upwardly from the heel-side end of the crown portion 3, and a shaft inserting hole 6*a* is opened at the upper end thereof.

The head 1 preferably has a volume of at least 300 cc, more preferably more than 350 cc, still more preferably more than 400 cc, yet still more preferably more than 410 cc, whereby the moment of inertia of the head 1 becomes large, so movement of the head at miss shots becomes decreased to improve the directional stability on the other hand, if the head volume is too large, it becomes difficult to avoid: deterioration of swing balance and lowering of head speed owing to a resultant head weight increase; or deterioration of durability owing to thinning of head components for the purpose of avoiding the undesirable head weight increase. From such a point of view, the upper limit of the head volume is preferably at most 500 cc, more preferably less than 450 cc.

From the same viewpoints as above, the weight of head 1 is preferably at least 170 grams, more preferably more than 175 grams, still more preferably more than 180 grams, but preferably at most 200 grams, more preferably less than 195 grams, still more preferably less than 190 grams.

For the head 1 having a volume of 400 cc or more, it is desirable that the depth of the center G of gravity of the head is at least 35.5 mm, more preferably at least 36.0 mm, further more preferably at least 37.5 mm. If less than 35.5 mm, the amount of movement of the head at miss shots becomes increased, so undesired side spin tends to occur on the struck ball and as a result the directional accuracy is lowered. Further, the moment of inertia of the head 1 tends to become small. As to the upper limit, on the other hand, if the depth of the center G of gravity is more than 43.0 mm, the sweet spot SS tends to shift toward the crown portion 3 from the geometric center of the club face F. In such a golf club head, there is a tendency that a ball is apt to be struck at a lower position on the sole side of the sweet spot SS, so the shot angle becomes low due to a vertical gear effect and the carry distance is decreased. Therefore, the depth of the center G of gravity is preferably at most 43.0 mm, more preferably at most 41.5 mm, further more preferably at most 40.0 mm.

Further, it is preferable for the head 1 having a volume of 400 cc or more that the moment of inertia of the head 1 is at least 4,100 gram sq.cm, more preferably more than 4,200 gram sq.cm, still more preferably more than 4,400 gram sq.cm, but at most 5,700 gram sq.cm, more preferably less than 5,500 gram sq.cm, still more preferably less than 4,700 gram sq.cm, yet more preferably less than 4,500 gram sq.cm. If the moment of inertia is less than 4,100 gram sq.cm, the amount of movement of head 1 at miss shots tends to become large to lower the directional accuracy. If the moment of inertia is more than 5,700 gram sq.cm, undesirable head weight increase is unavoidable and a shape of the club head becomes unconventional, so it is difficult to produce golf clubs having a proper weight balance.

The term "moment of inertia" as used herein means the moment of inertia measured on the head 1 alone around a vertical axis passing through the center G of gravity of the head 1 lied in the standard state.

Figure 3:
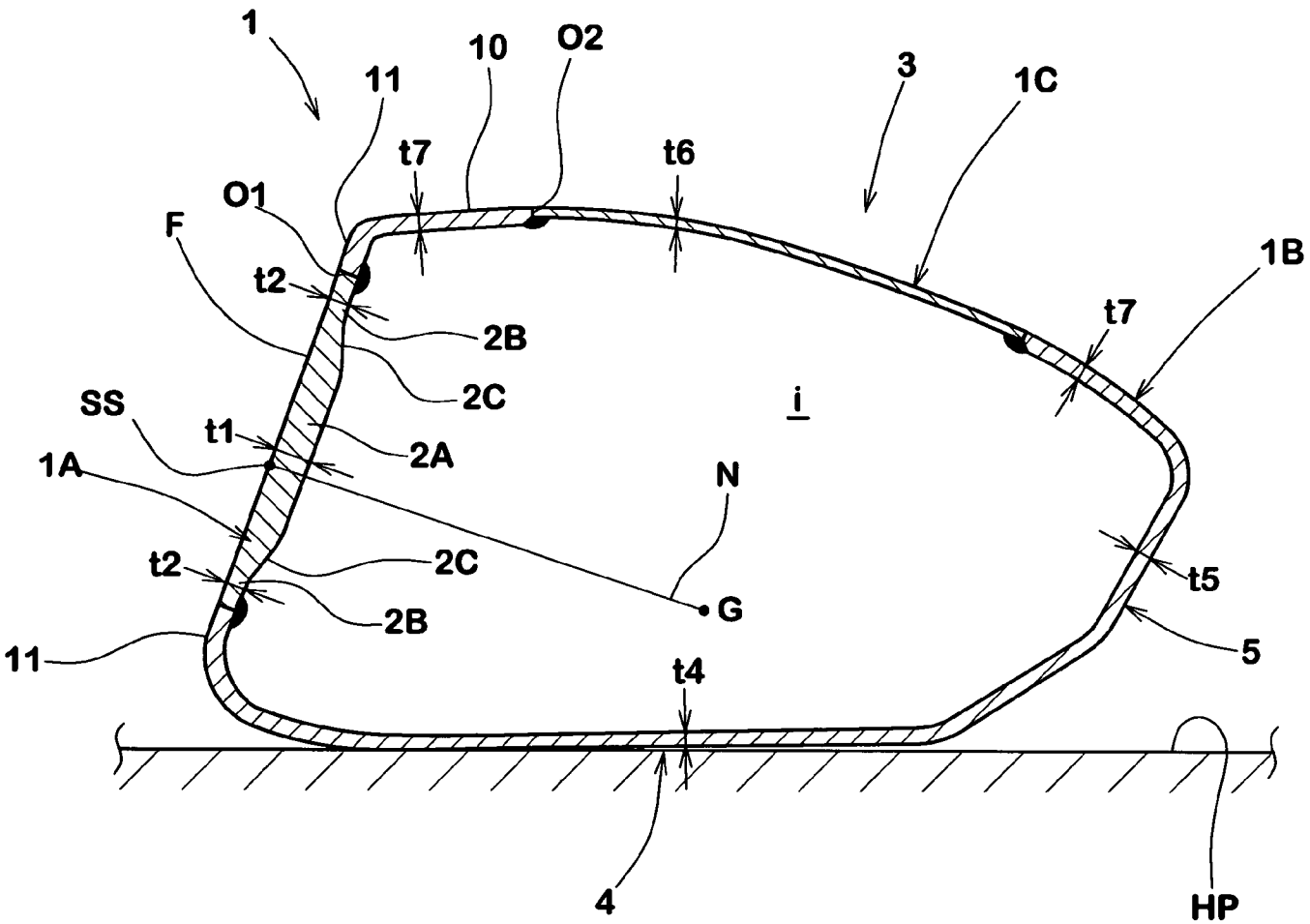
FIG. 3 is a cross sectional view taken along line A-A in FIG. 2 showing an embodiment having a three-piece structure.
Figure 6:
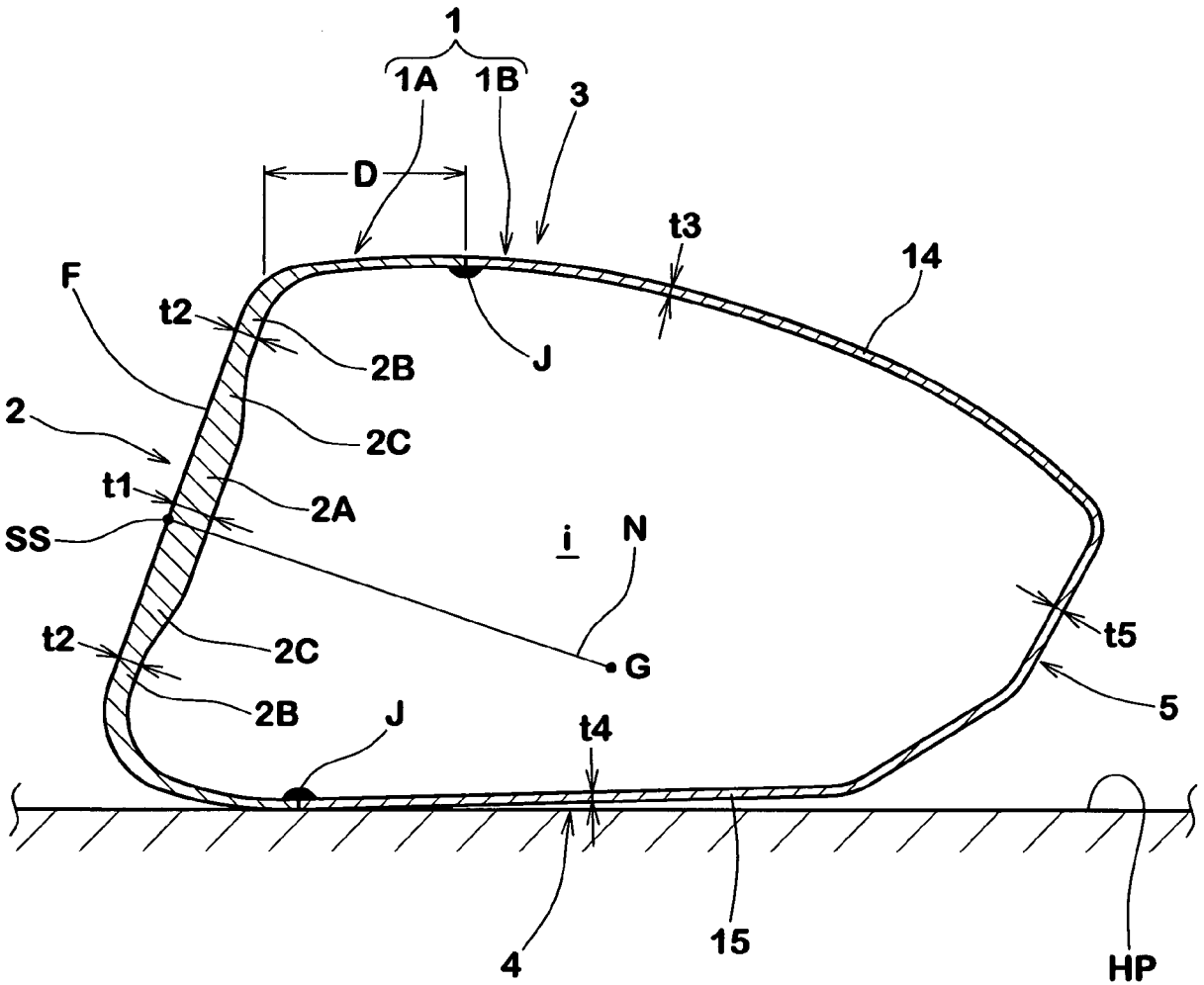
FIG. 6 is a cross sectional view taken along line A-A in FIG. 2 showing still another embodiment having a two-piece structure.

The term "standard state" as used herein denotes, as shown in FIGS. 2, 3 and 6, a state that the head 1 is placed on a horizontal plane HP with keeping the lie angle and loft angle (real loft angle) given to the head 1.

The term "sweet spot SS" denotes a point of intersection of the club face F and a straight line N normal to the club face F which is drawn from the center G of gravity.

The term "depth of the center G of gravity" as used herein means the length of the straight line N between the center G of gravity and the sweet spot SS.

As mentioned above, according to the new regulation, the coefficient of restitution of the head 1 can not exceed a certain value of 0.830 so that it can be used in official competitions adopting the new rule. On the other hand, if the coefficient of restitution is too low, it is difficult to obtain a desired long carry distance. It is therefore, preferable that the coefficient of restitution of the head 1 is at least 0.800, more preferably at least 0.810, still more preferably at least 0.820, yet still more preferably at least 0.825.

According to the present invention, the head 1 is composed of two or more parts or members including a face member 1A and a main member 1B.

Figure 4:
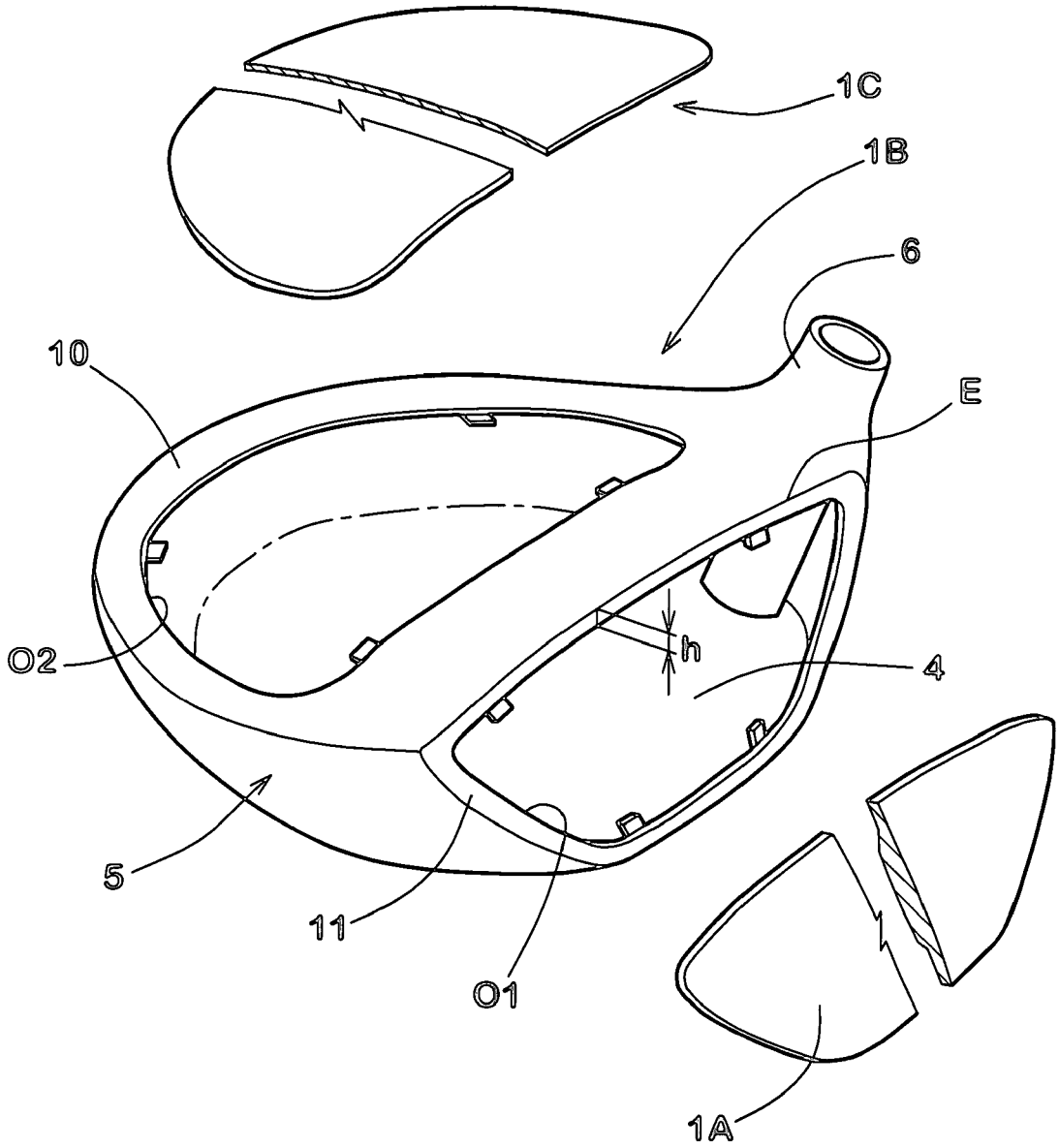
FIG. 4 is an exploded perspective view thereof.
Figure 5:
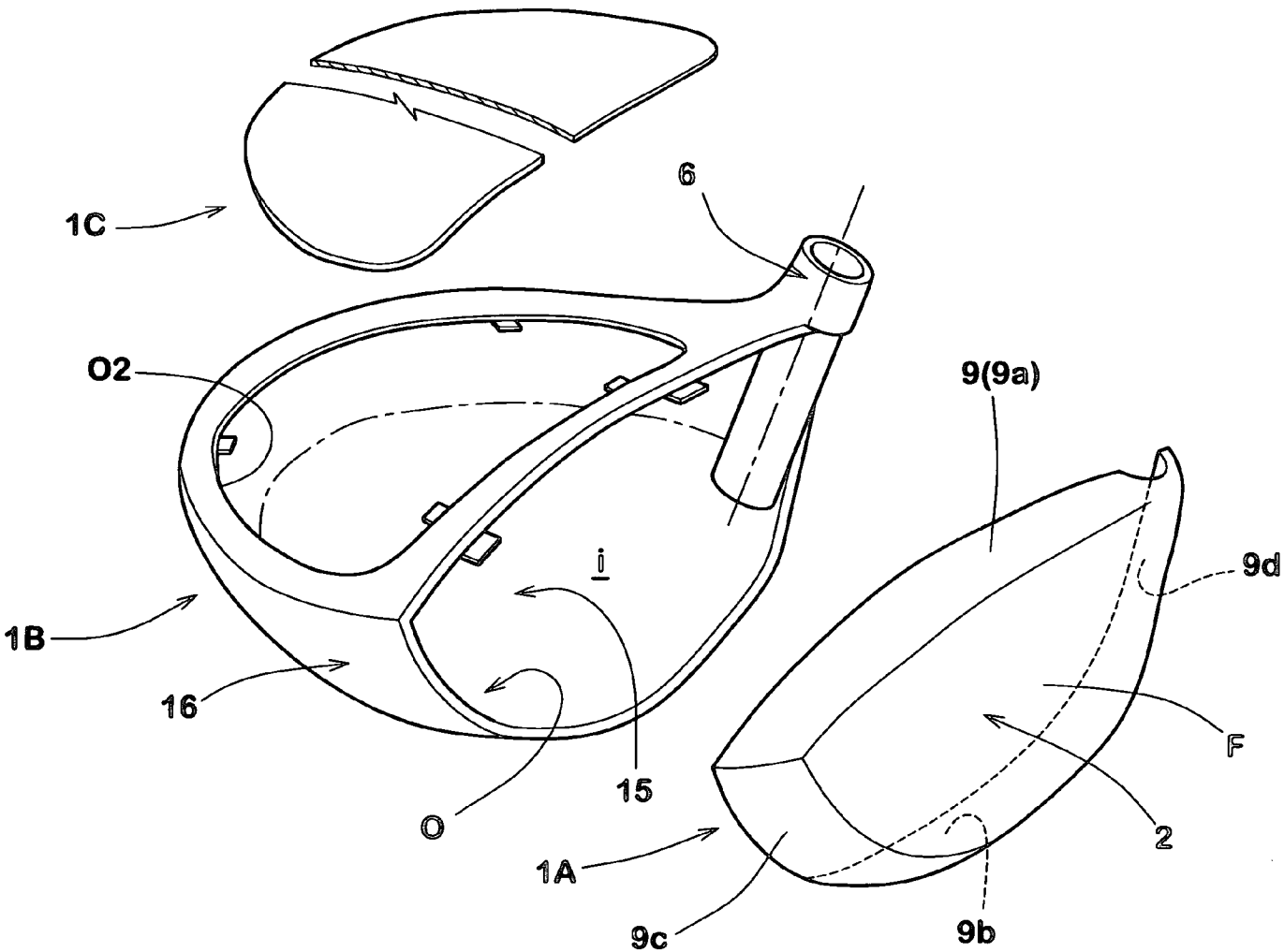
FIG. 5 is an exploded perspective view of a three-piece structure showing another embodiment of the present invention.

The face member 1A is to form a major part of the face portion 2 including the sweet spot SS. The face member 1A can be a plate type as shown in FIG. 4 or a cup type as shown in FIG. 5. Further, it may be an in-between type such that the undermentioned turnback 9 is provided along the upper edge Ea and lower edge Eb only for example.

The main member 1B comprises: an annular part to which the face member 1A is attached (welded in each embodiment); and a sole plate part 15 extending backward from the annular part so as to form the sole portion 4. In addition to the sole portion 4, the main member 1B can further comprise: a part 16 corresponding to the side portion 5 partially or wholly; and/or a part 14 corresponding to the crown portion 3 partially or wholly.

An embodiment having a three-piece stricture comprising the above-mentioned face member 1A and main member 1B and further a crown member 1C is shown in FIGS. 3 and 4.

Another embodiment having a three-piece stricture comprising the above-mentioned face member 1A and main member 1B and further a crown member 1C is shown in FIG. 5.

Figure 7:
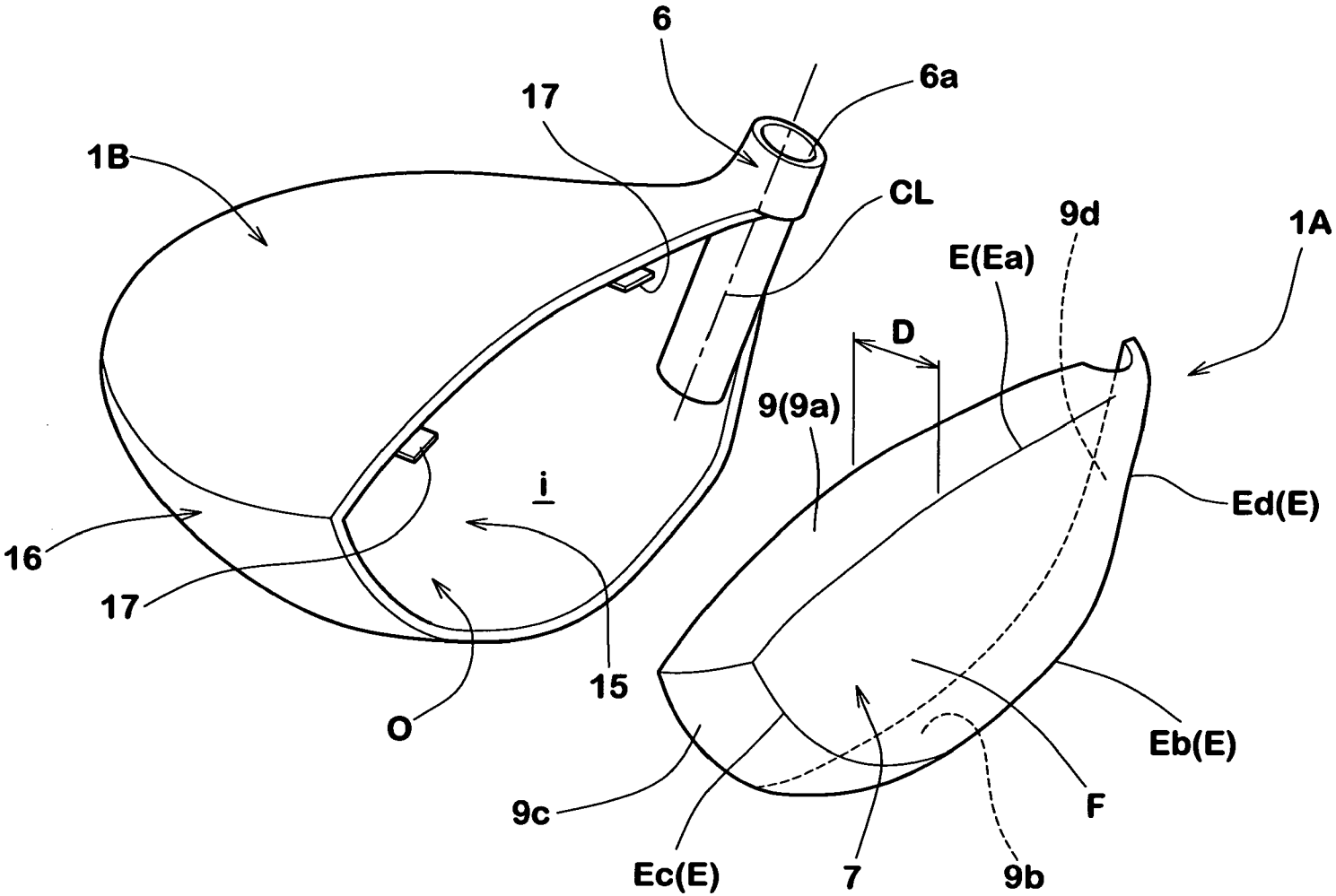
FIG. 7 is an exploded perspective view thereof.

Still another embodiment having a two-piece stricture comprising the face member 1A and main member 1B is shown in FIGS. 6 and 7.

*Three-Piece Structure with Plate-Type Face Member

In FIGS. 3 and 4, the head 1 is composed of the plate-type face member 1A, main member 1B and crown member 1C.

The face member 1A is a metal plate and has a contour which is slightly smaller than the line of the periphery edge E(=Ea+Eb+Ec+Ed) of the club face F, and extends substantially parallel with the periphery edge line. Thus, the contour shape of the face member 1A is similar to that of the club face F in this example, but the face member 1A is able to have various contour shapes as far as the sweet spot SS is included and the face member 1A occupies at least 60%, preferably more than 70%, more preferably more than 80% of the whole area of the club face F. This limitation to the occupied area is also applied to all the following embodiments.

The crown member 1C in this example is a slightly curved plate which forms a major part of the crown portion 3.

The main member 1B accordingly forms the remaining part of the head, and an opening O1 and opening O2 into which the face member 1A and crown member 1C are fitted, respectively, are formed in the face portion 2 and crown portion 3.

The outer circumferential edge of the face member 1A is welded to the circumferential edge of the opening O1.

The outer circumferential edge of the crown member 1C is welded to the circumferential edge of the opening O2.

More specifically, the main member 1B in this example is made up of the above-mentioned sole portion 4, side portion 5 and hosel portion 6 and further, a periphery part 10 of the crown portion 3 around the opening O2 and a periphery part 11 of the face portion 2 around the opening O1.

*Three-Piece Structure with Cup-Type Face Member

In FIG. 5, the head 1 is composed of the cup-type face member 1A, main member 1B and crown member 1C.

The crown member 1C is similarly to the above a slightly curved plate which forms a major part of the crown portion 3.

The face member 1A comprises: a face plate portion 7 which forms the major part of the face portion 2 as explained above; and a turnback 9 which extends toward the rear of the head from at least a part of the periphery edge E (Ea, Eb, EC and Ed).

The face plate portion 7 in this example forms the entirety of the face portion 2, but the face plate portion 7 may have various shapes as far as the above-mentioned limitation to the occupied area is satisfied and the sweet spot SS is included.

The turnback 9 in this example is formed along the entire length of the periphery edge E excluding a part in a corresponding position to a hosel tube extending into the hollow (i) from the hosel portion 6. Thus, the turnback 9 forms: a front part of the crown portion 3 (hereinafter the "crown turnback 9*a*"); a front part of the sole portion 4 (hereinafter the "sole turnback 9*b*"); a front part of the toe-side part of the side portion 5 (hereinafter the "toe turnback 9*c*"); and a front part of the heel-side part of the side portion 5 (hereinafter the "heel turnback 9*d*"), wherein the crown turnback 9*a* is provided in the heel-side end thereof with the part passing-over the hosel tube.

The main member 1B accordingly forms the remaining part of the head.

The front end of the main member 1B and the rear end of the turnback 9 are butt jointed by welding.

*Two-Piece Structure with Cup-Type Face Member

In FIGS. 6 and 7, the head 1 is composed of the face member 1A and main member 1B.

The face member 1A is of the above-mentioned cup-type.

The main member 1B accordingly forms the remaining part of the head, namely, the crown portion 3, sole portion 4 and side portion 5 excepting their front parts corresponding to the turnback, and the hosel portion 6.

Incidentally, a two-piece stricture of which face member 1A is the above-mentioned plate type is also possible although it is not illustrated.

*Materials for Making Face Member 1A and Main Member 1B

As to the materials for making the face member 1A and main member 1B, titanium alloys are advantageous since they are excellent in specific strength as compared with other metals, and easily available. In the present invention, therefore, the face member 1A is made of a titanium alloy (hereinafter referred to as "face member titanium alloy"), and the main member 1B is made of a titanium alloy (hereinafter referred to as "main member titanium alloy") having a larger specific gravity than that of the face member titanium alloy.

The face member 1A accordingly has a lower specific gravity than that of the main member 1B. Therefore, even if the thickness of the face portion 2 is increased in order to control the coefficient of restitution within the above-mentioned range provided in the golf rules, the shifting of the center G of gravity toward the front side can be minimized. Thus, it is possible to suppress deterioration of the directional accuracy of golf shots. Further, since both the face member 1A and main member 1B are similar metal materials, they can be easily welded each other. Therefore, the productivity and joint strength can be improved.

To effectively derive such advantages, the specific gravity sg1 of the face member titanium alloy is preferably set in a range of from not more than 4.50, more preferably not more than 4.42, still more preferably not more than 4.38, and the specific gravity sg2 of the main member titanium alloy is determined such that the ratio sg1/sg2 is less than 1.0, but not less than about 0.95.

If the specific gravity sg1 of the face member titanium alloy is more than 4.50, the weight of the head becomes increased on the face portion 2 side as the face portion 2 is formed thicker to lower the coefficient of restitution to less than 0.830, so the depth of the center G of gravity and the moment of inertia are apt to decrease.

As to the lower limit for the specific gravity sg1, it is better to set the lower limit as small as possible, but from practical reasons, e.g. ready availability, cost, strength, durability and the like, the specific gravity sg1 is preferably set in a range of about 4.30 or more.

As the face member titanium alloy, for instance, Ti—Al—Fe titanium alloys composed of 4.5 to 5.5% by weight of aluminum (Al), 0.5 to 1.5% by weight of iron (Fe) and the remaining amount of titanium (Ti) are preferred. Incidentally, there is possibility that unavoidable impurities are included in the alloy. These alloys can control the specific gravity to 4.40 or less, especially 4.38 or less, and can be processed to have a high Young's modulus and a high tensile strength by applying hot forging techniques in specific conditions as explained later.

With respect to the face member titanium alloy, if the aluminum content is less than 4.5% by weight, fragile ω-phase is easy to appear, so the tensile strength tends to be lowered. If the aluminum content is more than 5.5% by weight, the plastic deformation characteristic tends to be lowered to deteriorate the workability. "Fe" makes formation of intermetallic compounds difficult to thereby stabilize the β-phase and to lower the deformation stress and, therefore, it serves to raise the plastic deformation characteristic so as to improve the workability. Therefore, if the "Fe" content is less than 0.5% by weight, such effect tends to become insufficient. On the other hand, "Fe" is easy to cause hardening and going fragile if the alloy is kept at about 500 deg.C. for a long time, so handling becomes difficult upon manufacturing. For such a reason, it is preferable that the upper limit of the "Fe" content is 1.5% by weight. Incidentally, there is a possibility that "O", "N", "C" and/or "H" are included as the unavoidable impurities mentioned above.

It is particularly preferable that the face member titanium alloy has:

a Young's modulus Y1 of not less than 120 GPa, more preferably more than 125 GPa, still more preferably more than 130 GPa, but not more than 150 GPa, more preferably less than 145 GPa, still more preferably less than 140 GPa, yet still more preferably less than 135 GPa; and a tensile strength S1 of not less than 950 MPa, more preferably more than 1,000 MPa, still more preferably more than 1,100 MPa, yet still more preferably more than 1,200 MPa, but not more than 2,200 MPa, more preferably less than 1,800 MPa, still more preferably less than 1,600 MPa.

When the face member titanium alloy having such high Young's modulus Y1 and tensile strength S1 is used in the face portion 2, the coefficient of restitution can be decreased while minimizing the increase in thickness. Moreover, the strength of the face portion 2 is not impaired. In other words, such a face member titanium alloy can realize a low coefficient of restitution while suppressing the increase in the weight on the face side. Therefore, it is possible to easily provide a golf club head having a controlled coefficient of restitution within the range specified by golf rules without lowering the durability and decreasing the depth of the center G of gravity. Also, such a face member titanium alloy has a higher tensile strength S1 than alloys conventionally used in golf club heads. Therefore, sufficient strength and durability can be secured without increasing the thickness in excess. That is to say, the head 1 can control the coefficient of restitution within the range specified by golf rules while preventing the depth of the center G of gravity from decreasing.

If the Young's modulus Y1 of the face member titanium alloy is less than 120 GPa, the rigidity of the face portion 2 is apt to be lowered owing to the material characteristics and, therefore, it is required to further increase the thickness of the face portion 2 for controlling the coefficient of restitution within the range specified by golf rules, thus resulting in tendency that the depth of the center G of gravity becomes shallow to lower the directional accuracy of shots because of increase in the weight of the face member 1A. On the other hand, if the Young's modulus Y1 is more than 150 GPa, there is a tendency that the coefficient of restitution becomes very small when the face portion 2 is formed to have a thickness which satisfies the strength and durability, so the carry distance decrease.

If the tensile strength S1 of the face member titanium alloy is less than 950 MPa, the face portion 2 must be made considerably thick in order to secure durability and strength durable against repeated ball hitting. In that case, the rebound performance of the head tends to be remarkably lowered or the weight of the face portion 2 tends to be increased to decrease the depth of the center G of gravity.

On the other hand, if the tensile strength S1 is more than 2,200 MPa, the toughness as a general characteristic of titanium alloys is lowered, so the head becomes fragile to lower the durability.

Like the face member titanium alloy, the main member titanium alloy is also desired to have a strength and a Young's modulus Y2 which are sufficient to use in head 1.

Therefore, it is preferable that the main member titanium alloy has a tensile strength S2 of at least 900 MPa, especially at least 1,000 MPa, but at most 1,200 MPa.

Also it is preferable that the main member titanium alloy has a Young's modulus Y2 of at least 100 GPa, especially at least 105 GPa, but at most 120 GPa, especially at most 115 GPa.

In particular, it is preferable that the ratio Y1/Y2 of the Young's modulus Y1 to the Young's modulus Y2 is at least 1.0, more preferably at least 1.05, still more preferably at least 1.10, but at most 1.50, more preferably at most 1.35, still more preferably at most 1.30.

Also, the ratio S1/S2 of the tensile strength S1 to the tensile strength S2 is preferably at least 1.05, but at most 1.35, more preferably at most 1.30.

By defining the Y1/Y2 ratio and S1/S2 ratio as above, stress concentration at the joint portion between the face and main members can be avoided to improve the durability of the junction.

As the main member titanium alloy, various titanium alloys can be used as far as they have the above characteristics. However, if the specific gravity is too large, marked increase in head weight is easy to occur. Therefore, titanium alloys having a specific gravity of 4.51 or less are preferred. In the embodiments described herein, Ti-6Al-4V titanium alloy is used as the main member titanium alloy.

*Crown Member

As to the above-mentioned crown member 1C on the other hand, various materials may be used. For instance, metal materials, e.g. titanium alloys, aluminum alloys, stainless steels and the like, and further resin materials including FRP materials, e.g. carbon fiber reinforced resins can be used.

In the above-mentioned embodiments, however, a titanium alloy is used (hereinafter the "crown member titanium alloy"). For instance, Ti-15V-3Cr-3Al-3Sn, Ti-15V-6Cr-4Al, Ti-22V-4Al, Ti-13V-11Cr-3Al, Ti-4.5Al-3V-2Mo-2Fe and the like are preferably used though not limited thereto.

In order to reduce the head weight in the crown portion 3 with keeping the durability, usually, a different titanium alloy from the face and main member titanium alloys which has a higher strength and a lower Young's modulus is used so as to be able to decrease the thickness of the crown member to thereby reduce the weight. Accordingly, a large weight margin can be obtained and design freedom for the head weight distribution can be improved. Also, there are further advantages such that the crown member 1C and main member 1B can be easily welded each other because these are made from similar materials, and the productivity may be improved.

If the tensile strength S3 of the crown member titanium alloy is less than 1,000 MPa, it becomes difficult to keep the durability to the minimum necessary. Therefore, the tensile strength S3 is at least 1,000 MPa, preferably more than 1,100 MPa. Like this, the larger tensile strength S3 may be better for reducing the thickness, but in view of toughness, it is preferable that the tensile strength S3 is at most 1,400 GPa, more preferably at most 1,250 GPa.

If the Young's modulus is excessively large, damages such as breaking or cracking are liable to occur at impact, because a large impact force acts on the crown portion 3. If the Young's modulus is too small on the other hand, there is a possibility that the deflection of the face portion is furthered to increase the coefficient of restitution over the regulated value. From such points of view, it is preferable that the crown member titanium alloy has a Young's modulus Y3 of at least 85 GPa, especially at least 90 GPa, but at most 110 GPa, especially at most 105 GPa.

In particular, it is preferable that the Young's modulus Y3 of the crown member titanium alloy is smaller than the Young's modulus Y2 of the main member titanium alloy.

In case that it is desired to reduce the head weight in the crown portion by decreasing the thickness of the crown member 1C, if the specific gravity of the crown member titanium alloy is large, it nullifies the thinning. Therefore, it is preferable that the specific gravity of the crown member titanium alloy is at most about 4.80, but at least about 4.60.

If the proportion of the crown member 1C to the crown portion 3 is small, a large weight margin can not be obtained.

If the proportion becomes too large and as a result the above-mentioned annular part to which the face member 1A is attached becomes too narrow in width, damages such as deformation or breaking are liable to occur at impact. From such points of view, the area of the crown member 1C is at most 80%, more preferably at most 75%, still more preferably at most 70% of the whole area of the crown portion 3. But, in view of the weight margin, the area of the crown member 1C is at least 50%, preferably at least 55% of the whole area of the crown portion 3.

Figure 8:
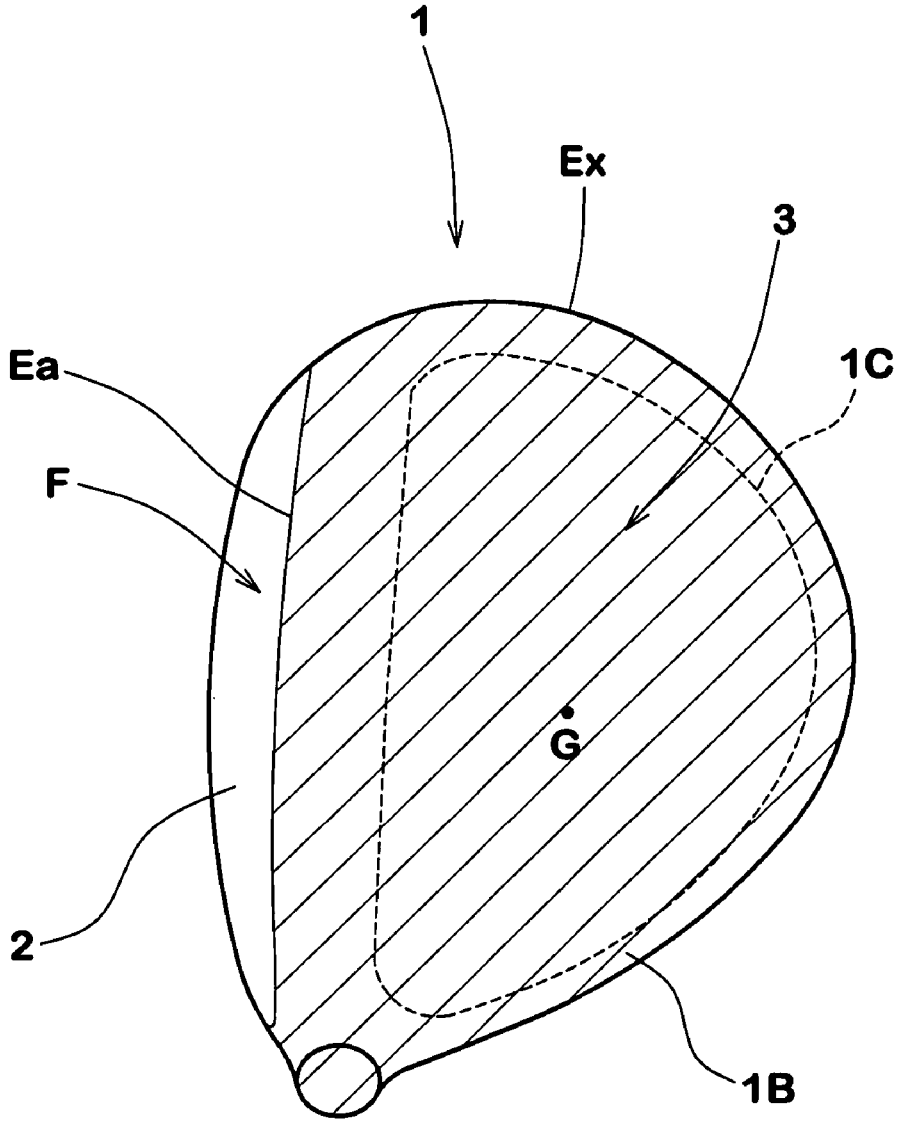
FIG. 8 is a top view of the wood-type golf club head for explaining the undermentioned horizontal projected areas.

Here, the area of the crown member 1C and the whole area of the crown portion 3 each mean a horizontal projected area obtained in the standard state of the head. In a horizontal projection drawing of the head obtained by projecting the head on the horizontal plane HP as shown in FIG. 8, the area of the crown member 1C is that of the region corresponding to the crown member 1C, but the whole area of the crown portion 3 means the area of a region defined by the contour line Ex of the head and the line of the upper edge Ea of the club face F as indicated as the hatched region in FIG. 8.

Figure 9A:
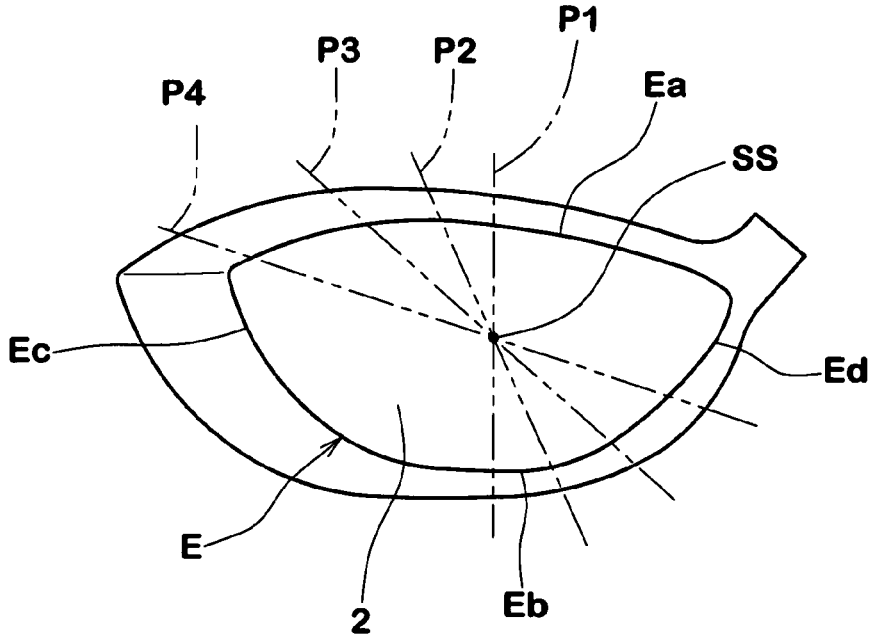
FIGS. 9(A) and 9(B) are a front view and cross sectional view of the wood-type golf club head for explaining the periphery edge of the club face.
Figure 9B:
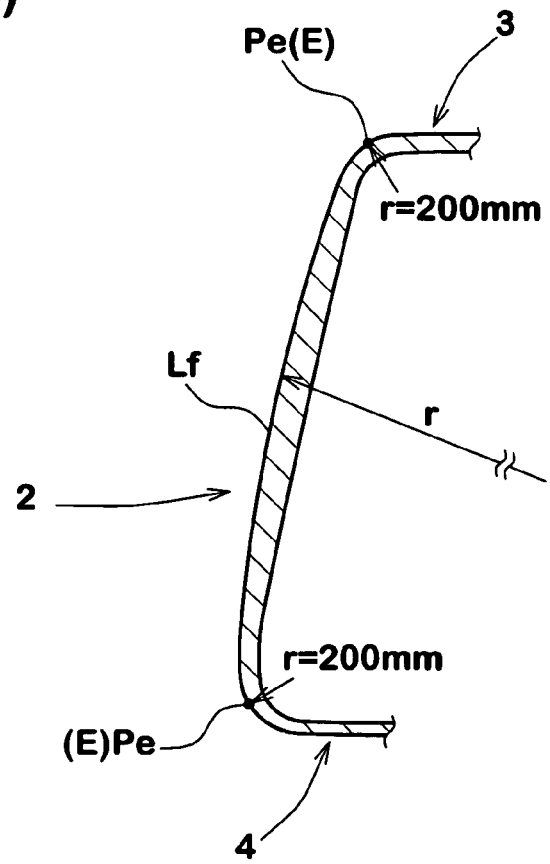

If the periphery edge E inclusive of upper edge Ea is unclear due to smooth change in the curvature, a virtual edge line (Pe) which is defined, based on the curvature change is used instead as follows. AS shown in FIGS. 9(A) and 9(B), in each cutting plane P1, P2—including the above-mentioned straight line N, a point Pe at which the radius (r) of curvature of the profile line Lf of the face portion first becomes under 200 mm in the course from the center SS to the periphery of the club face is determined. Then, the virtual edge line is defined as a locus of the points Pe.

Even when the specific gravity is limited as above, if the thickness t6 of the crown member 1C is more than 0.70 mm, it would be difficult to obtain a sufficient weight margin.

Therefore, it is preferable that the thickness t6 is at most 0.70 mm, more preferably at most 0.60 mm, still more preferably at most 0.55 mm. However, if the thickness t6 becomes too small, it becomes difficult for the crown member 1C to withstand impact forces. From such a point of view, the thickness t6 is preferably at least 0.30 mm, more preferably at least 0.40 mm, further more preferably at least 0.45 mm.

Further, it is preferable that the thickness t7 of the crown periphery part 10 around the opening O2 is more than the thickness t6 of the crown member 1C in order to raise the durability of the crown portion 3. Specifically, the thickness t7 is more than 0.7 mm but preferably not more than 0.9 mm.

In case that, without using the crown member 1C, the crown portion 3 is integrally formed with the side portion 5 and sole portion 4 as in the two-piece structure, the lower limit for the thickness of the crown portion 3 may be set at a slightly lower value since there is no weak joint part in the crown portion 3. In such case, the thickness t3 of the crown portion 3, and also the thickness t4 of the sole portion 4 and the thickness t5 of the side portion 5, are set in a range of at least 0.65 mm, preferably at least 0.70 mm, in view of the durability, strength and the like. But, if these thickness are too large, the head weight increases, so the degree of freedom in weight distribution design tends to be impaired. From such points of view, it is preferable that the thickness t3, t4 and t5 are each set in a range of at most 1.2 mm, especially at most 1.1 mm.

*Face Portion

The above-mentioned face portion 2 may be formed in a substantially constant thickness, but in each embodiment, the face portion 2 is provided with a thin annular peripheral portion 2B surrounding the resultant thicker central portion 2A. The central portion 2A includes the sweet spot SS and has a thickness t1 (defining the maximum thickness of the face portion). The thin peripheral portion 2B has a thickness t2 less than the thickness t1 (including the minimum thickness of the face portion).

In order to avoid stress concentration at the boundary between the portions 2A and 2B to thereby further improve the durability of the face portion 2, the face portion 2 is provided between the central portion 2A and the peripheral portion 2B with a thickness-transitional portion 2C having a variable thickness gradually changes from the portion 2A to portion 2B is provided.

Preferably, the thickness t1 is set in a range of not less than 2.90 mm, more preferably not less than 2.95 mm, still more preferably not less than 3.0 mm, but not more than 3.5 mm, more preferably not more than 3.4 mm, still more preferably not more than 3.3 mm. If the thickness t1 is less than 2.90 mm, the coefficient of restitution of the head 1 tends to exceed the upper limit defined by golf rules, and if the thickness to is more than 3.5 mm, the weight of the face portion 2 tends to increase to decrease the depth of the center G of gravity.

On the other hand, if the thickness t2 is less than 2.35 mm, the durability of the face portion 2 tends to become insufficient. If the thickness t2 is more than 2.7 mm, the rebound performance of the head 1 is excessively lowered. Therefore, the thickness t2 is preferably set in a range of not less than 2.35 mm, more preferably not less than 2.40 mm, still more preferably not less than 2.50 mm, but not more than 2.70 mm, more preferably not more than 2.60 mm.

These limitations are applied to the face portion 2 regardless of the above-mentioned face member type, namely, plate, cup, in-between type.

*Turnback

As explained, the above-mentioned cup-type and in-between type face members 1A include the turnback 9.

The face member 1A and main member 1B are welded each other, therefore, a weld bead is more or less formed on the inside of the joint part J.

In the case of the plate-type face member 1A as shown in FIG. 3, if such a weld bead is large in volume, the weight of the face portion is unfavorably increased. Therefore, it is necessary to weld with the greatest care not to grow the unavoidable weld bead but to maintain the necessary joint strength and durability. However, by providing the turnback 9, the joint part J of the face member 1A and main member 1B backs away from the face portion. Even if therefore, a relatively large weld bead is remained, as the resultant weight increase occurs far from the face portion, a decrease in the depth of the center G of gravity can be prevented. There is rather a possibility that the depth is increased by the weld bead having a large volume. Thus, the welding workability can be improved.

From such points of view, it is preferable that the turnback 9 has a depth D of at least 7 mm, more preferably more than 10 mm, still more preferably more than 15 mm when measured from the front end (namely, the periphery edge E) to the rear end of the turnback 9 in the front-back direction of the head in the above-mentioned standard state.

If however, the depth D is too large, the productivity of the cup-type face member 1A tends to be lowered since it becomes difficult to form the cup-type face member 1A by plastic deformation working such as forging or press working. In the case of the cup-type therefore, it is preferable that the depth D of the turnback 9 is at most 30 mm, more preferably at most 28 mm, still more preferably at most 25 mm.

As to the thickness of the turnback 9, it is preferable that, in the joint part J of the face member 1A and main member 1B, the thickness of the face member 1A (or turnback 9) is substantially the same as that of the main member 1B. Specifically, at the rear end or edge of the turnback 9, the thicknesses of the crown turnback 9*a*, sole turnback 9*b*, and toe and heel turnback 9*c* and 9*d* are substantially the same as the thicknesses t3, t4 and t5 of the crown, sole and side portions of the main member 1B, respectively.

*Manufacturing Method

The main member 1B can be produced by casting, forging and other known methods. But, the main member 1B in each embodiment is produced by lost-wax precision casting of the titanium alloy.

As the face member 1A and crown member 1C are fitted to the respective openings O1 and O2 of the main member 1B, and their opposite edges are welded to each other. Therefore, to facilitate the positioning and to receive the face member 1A and crown member 1B, the openings O1, O2 are each provided with pick-like projections 17 along the circumference thereof at intervals.

As to the face member 1A on the other hand, it may be possible to produce each type of face member 1A by casting, and to produce two-types of face member 1A with the turnback 9 by welding the separate turnback 9 to the face plate portion 7. But, it is preferable that the face member 1A is formed by means of plastic forming such as bending, press working and forging. More preferably, the face member 1A is formed by hot forging the titanium alloy, regardless of with or without the turnback 9.

Through such hot forging process, voids which may be present in the crystal structure of the alloy can be eliminated, and internal defects and segregation are decreased whereby the fineness of the crystal structure is improved to achieve excellent durability. Further, variations in the mechanical properties such as tensile strength and hardness can be decreased, and as a grain flow occurs along the shape of products, the toughness and the fatigue resistance can be improved.

For instance, the hot forging is carried out as follows: First, from a starting material, e.g. a round rod-like billet, a plate-like flat material is formed by heating and striking or pressing it into a predetermined shape.

Here, in order to improve the strength of the material and the formability, the billet is heated up to a temperature in a range of from 930 to 950 deg.C. and kept for at least 3 minutes, but at most 30 minutes in this temperature range, using an electric furnace for instance. If this heat treatment time is less than 3 minutes, it is difficult to evenly and sufficiently heat up the material and the workability liable to become lower. If the time is more than 30 minutes, unfavorable change in the crystal structure is easy to occur which makes the forged material fragile, so the strength tends to be decreased to lower the durability of the face portion 2. If the temperature is lower than 930 deg.C., the workability is lowered, so the formability into a desired shape tends to be lowered to lower the yield. If the temperature is higher than 950 deg.C., unfavorable change in the crystal structure occurs.

Then, the plate-like flat material prepared as above is subjected to compression plastic deformation, while being heated. To cause such plastic deformation, dies (including open-type, closed-type and semi-closed-type dies) are used. Preferably, closed-type dies are used not to produce an oxide film (scale) on the surface of the shaped material. Incidentally, the plastic deformation can be conducted in multi-stages, e.g., rough shaping, final precision shaping and optional intermediate shaping with using dies having gradually changed shapes.

Thereafter, if necessary, the formed face member 1A is subjected to grinding and/or polishing in order to deburr the edge and to remove an oxide film on the surface and the like.

The thus obtained face member 1A is welded to the main member 1B.

Further, in the case of three-piece structure, the crown member 1C is welded to the main member 1B. In the case of the crown member 1C made of nonmetal material such as FRPS, the crown member 1C is fixed to the main member 1B by appropriate means, e.g. adhesive agent, welding and the like.

In the above embodiments, a Ti—Al—Fe titanium alloy having a specific gravity of 4.38 is used to make the face member 1A; a Ti-6Al-4V titanium alloy having a specific gravity of 4.42 is used to make the main member 1B; and a Ti-15V-3Cr-3Al-3Sn titanium alloy having a specific gravity of 4.76 is used to make the crown member 1C.

*Comparison Tests

In order to confirm the effects of the present invention, wood golf club heads were prepared according to the specifications shown in Table 1 and tested.

The specifications common to all the heads are as follows:

Head volume: 450 cc

Loft angle: 10 degrees

Main member: Ti-6Al-4V

Crown member: Ti-15V-3Cr-3Al-3Sn

The face members used in Examples 1-4 are forged products prepared by hot forging a Ti-5Al-1Fe titanium alloy (5% by weight of "Al", 1% by weight of "Fe", and "Ti" as the remainder inclusive of unavoidable impurities) at 940 deg.C. for 10 minutes. The face members used in Comparative Examples 1-2 are forged products prepared by hot forging a Ti-6Al-4v titanium alloy (6% by weight of "Al", 4% by weight of "V", and "Ti" as the remainder inclusive of unavoidable impurities) at 990 deg.C. for 10 minutes. As to the heads having the crown member, the crown member was joined to the main member by TIG welding.

The comparison tests conducted are as follows:

Coefficient of Restitution Test:

The coefficient of restitution was measured according to the USGA Procedure for Measuring the velocity Ratio of a Club Head for conformance to Rule 4-1e, Revision 2, Feb. 8, 1999. The measurement was repeated 10 times for each head, and the average value thereof is shown in Table 1. The larger the value, the better, but the value must be less than 0.830 in order to satisfy the golf rules such as the USGA Golf Rules.

Carry Distance and Directional Stability Test:

All the heads were attached to the same FRP shafts to make 46-inch wood clubs. Ten right-handed amateur golfers (handicap 10 to 20) struck 10 balls with each club, to measure the carry distance and the amount (yard) of rightward or leftward swerve from the intended target course to the stop position of the ball, wherein the amount of swerve is treated as a positive value regardless of whether the swerve is rightward or leftward. The results of measurement of the carry distance and the amount of swerve are shown in Table 1 as the average values obtained by striking 100 balls (10×10) for each club. The larger the value, the longer the carry distance. The smaller the value, the better the directional stability.

Durability Test:

Each of the above wood golf clubs was attached to a swing machine, and golf balls were repeatedly struck at a head speed set to 55 m/s at the ball striking position (sweet spot). The number of struck balls up to generation of damage on the head was counted while visually checking the head every 10 shots. The results are shown in Table 1 as an index based on the result of Example 1 being 100. The larger the value, the better the durability.

TABLE 1

| Club head | Com. Ex. 1 | Ex. 1 | Ex. 2 | Com. Ex. 2 | Ex. 3 | Ex. 4 |
|---|---|---|---|---|---|---|
| Structure | FIG. 7 | FIG. 7 | FIG. 7 | FIG. 4 | FIG. 4 | FIG. 5 |
| Face member | | | | | | |
| Material | Ti-6Al-4V | Ti-5Al-1Fe | Ti-5Al-1Fe | Ti-6Al-4V | Ti-5Al-1Fe | Ti-5Al-1Fe |
| Specific gravity sg1 | 4.42 | 4.38 | 4.38 | 4.42 | 4.38 | 4.38 |
| Tensile strength S1 (MPa) | 1200 | 1300 | 1300 | 1200 | 1300 | 1300 |
| Young's modulus Y1 (GPa) | 115 | 135 | 135 | 115 | 135 | 135 |
| Thickness t1 (mm) | 3.27 | 3.05 | 3.15 | 3.32 | 3.15 | 3.05 |
| Thickness t2 (mm) | 2.70 | 2.47 | 2.55 | 2.81 | 2.55 | 2.50 |
| Total weight (g) | 71.1 | 65.1 | 67.3 | 74.0 | 67.3 | 65.5 |
| Main member | | | | | | |
| Material | Ti-6Al-4V | " | " | " | " | " |
| Specific gravity sg2 | 4.42 | " | " | " | " | " |
| Tensile strength S2 (MPa) | 1200 | " | " | " | " | " |
| Young's modulus Y2 (GPa) | 115 | " | " | " | " | " |
| Crown member | none | none | none | | | |
| Material | — | — | — | | Ti-15V-3Cr-3Al-3Sn | |

TABLE 1-continued

| Club head | Com. Ex. 1 | Ex. 1 | Ex. 2 | Com. Ex. 2 | Ex. 3 | Ex. 4 |
|---|---|---|---|---|---|---|
| Specific gravity sg3 | — | — | — | 4.76 | 4.76 | 4.76 |
| Tensile strength S3 (MPa) | — | — | — | 1300 | 1300 | 1300 |
| Young's modulus Y3 (GPa) | — | — | — | 105 | 105 | 105 |
| Thickness t6 (mm) | — | — | — | 0.50 | 0.50 | 0.50 |
| Area/whole area (%) | — | — | — | 0.60 | 0.60 | 0.60 |
| Total weight of crown portion (g) | 35.1 | 35.1 | 35.1 | 28.4 | 28.4 | 26.8 |
| Y1/Y2 ratio | 1.00 | 1.17 | 1.17 | 1.00 | 1.17 | 1.17 |
| S1/S2 ratio | 1.00 | 1.08 | 1.08 | 1.00 | 1.08 | 1.08 |
| Total weight of head (g) | 191.0 | 191.0 | 191.0 | 191.0 | 191.0 | 191.0 |
| Depth of center of gravity (mm) | 35.5 | 37.3 | 36.9 | 36.8 | 39.0 | 39.5 |
| Coefficient of restitution | 0.828 | 0.828 | 0.820 | 0.820 | 0.820 | 0.827 |
| Carry distance (yard) | 210.3 | 213.4 | 212.2 | 211.4 | 215.0 | 216.8 |
| Swerve (yard) | 7.9 | 7.0 | 7.4 | 7.4 | 6.5 | 6.2 |
| Durability (index) | 100 | 105 | 113 | 110 | 113 | 106 |

It is observed in Table 1 that the golf club heads of Examples 1 to 4 according to the present invention have a depth of the center G of gravity kept large while suppressing rise in the coefficient of restitution and, as a result, they have an excellent directional stability.

As described above, in the golf club heads according to the present invention, a coefficient of restitution which is near but less than 0.830 can be easily provided, without decreasing the depth of the center of gravity.

The invention claimed is:

1. A golf club head having a hollow structure comprising a face portion, a crown portion, a sole portion, a side portion, and a hosel portion, and composed of a main member provided with a top opening in the crown portion and a front opening in the face portion, a face member covering the front opening and forming a club face for striking a ball, and a crown member covering the top opening, wherein said face member is made of a first titanium alloy, said main member is made of a second titanium alloy having a larger specific gravity than that of said first titanium alloy, said crown member is made of a third titanium alloy different from the first and second titanium alloys, the main member is a casting of the second titanium alloy integrally including the sole portion, the side portion, the hosel portion, a periphery part of the crown portion around the top opening, and a periphery part of the face portion around the front opening, the sole portion has a thickness of at least 0.65 mm, the side portion has a thickness of at least 0.65 mm, the crown member has a thickness of at most 0.60 nun, the area of the crown member is at least 50% of the area of the crown portion, and the face member has a Young's modulus Y1 of 120 to 150 GPa and a tensile strength of 950 to 2,200 MPa.

2. The golf club head according to claim 1, wherein said first titanium alloy is composed of 4.5 to 5.5% by weight of aluminum, 0.5 to 1.5% by weight of iron and the remaining amount of titanium inclusive of unavoidable impurities.

3. The golf club head according to claim 1, which has a head volume of at least 400 cc, a head weight of 170 to 200 g and a coefficient of restitution in a range of not less than 0.800 but less than 0.830.

4. The golf club head according to claim 1, wherein the face portion is provided with a thicker central portion including the sweet spot, and a thin annular peripheral portion surrounding the central portion, wherein the central portion has a thickness in a range of from 2.90 to 3.5 mm, and the peripheral portion has a thickness of not more than 2.70 mm, and the face portion is further provided between said central portion and peripheral portion with a thickness-transitional portion having a variable thickness gradually changes from the central portion to the peripheral portion.

5. The golf club head according to claim 1, wherein a moment of inertia of the head around a vertical axis passing through the center of gravity of the head is in a range of from 4,100 to 5,700 gram sq. cm.

6. The golf club head according to claim 1 or 4, wherein the Young's modulus Y1 of the face member is at least 1.05 times the Young's modulus Y2 of the main member.

7. The golf club head according to claim 1 or 4, wherein the Young's modulus Y3 of the crown member is smaller than the Young's modulus Y2 of the main member.

8. The golf club head according to claim 1 or 4, wherein the Young's modulus Y1 of the face member is at least 1.05 times the Young's modulus Y2 of the main member, and the Young's modulus Y3 of the crown member is smaller than the Young's modulus Y2 of the main member.

9. The golf club head according to claim 1, wherein the Young's modulus Y3 of the crown member is at most 110 GPa.

10. A method for manufacturing the golf club head of claim 1 comprising: heating the first titanium alloy at a temperature of from 930 to 950 deg. C. for 3 to 30 minutes; and hot forging the heated first titanium alloy into said face member.

* * * * *